US006318039B1

(12) United States Patent
Watson et al.

(10) Patent No.: US 6,318,039 B1
(45) Date of Patent: Nov. 20, 2001

(54) CORNICE OR CROWN MOLDING FINISHING ACCESSORY

(76) Inventors: Tom Watson; Scott Thompson, both of 8805-6 Street SE., Calgary, Alberta (CA), T2H 1M1

( * ) Notice: Subject to any disclaimer, the term of this patent is extended or adjusted under 35 U.S.C. 154(b) by 0 days.

(21) Appl. No.: 09/655,052

(22) Filed: Sep. 5, 2000

(51) Int. Cl.[7] ..... E04B 2/00

(52) U.S. Cl. ..... 52/288; 52/288.1; 52/211; 52/408; 52/717.08; 52/717.05; 52/716.1

(58) Field of Search ..... 52/288.1, 288, 52/287, 211, 408, 717.03, 717.05, 716.1

(56) References Cited

U.S. PATENT DOCUMENTS

| | | | | |
|---|---|---|---|---|
| 3,707,061 | | 12/1972 | Collette et al. | 52/288 |
| 3,956,861 | | 5/1976 | Rasmussen | 52/287 |
| 5,001,877 | | 3/1991 | Edwards | 52/288 |
| 5,199,237 | | 4/1993 | Juntunen | 52/288 |
| 5,544,463 | * | 8/1996 | Bergin | 52/288.1 |
| 5,592,797 | | 1/1997 | Logan et al. | 52/288.1 |
| 5,651,224 | | 7/1997 | Brabant | 52/288.1 |
| 5,802,790 | | 9/1998 | Lamont et al. | 52/288.1 |
| 5,809,718 | | 9/1998 | Wicks | 52/287.1 |

* cited by examiner

*Primary Examiner*—Carl D. Friedman
*Assistant Examiner*—Chi Nguyen
(74) *Attorney, Agent, or Firm*—David S. Thompson

(57) ABSTRACT

A cornice or crown molding finishing accessory (10) allows creation of a smooth, continuous and aesthetic finish to the joint between first and second molding segments. These molding segments may be oriented to form inside or outside corners. Preferred examples of the finishing accessory are adapted for use with outside and inside 90-degree corners. The molding finishing accessory provides first and second facade-creating flanges (20), (40) which have a cross-sectional shape including a molding-conforming curve designed to match the cross-sectional decorative surface of the molding segments. The flanges meet at a vertex (60), from which an anchor element extends. In use, the anchor element (80) is inserted into a gap defined between the first and second molding segments, thereby holding the finishing accessory in place. A thin layer of drywall "mud" is brushed over flanges of the finishing accessory and adjacent areas of the molding segments, thereby smoothing over any lines of transition between the finishing accessory and the molding segments. The resulting appearance is that of a perfect transition between the first and second molding segments, and complete masking of the gap between these segments.

3 Claims, 5 Drawing Sheets

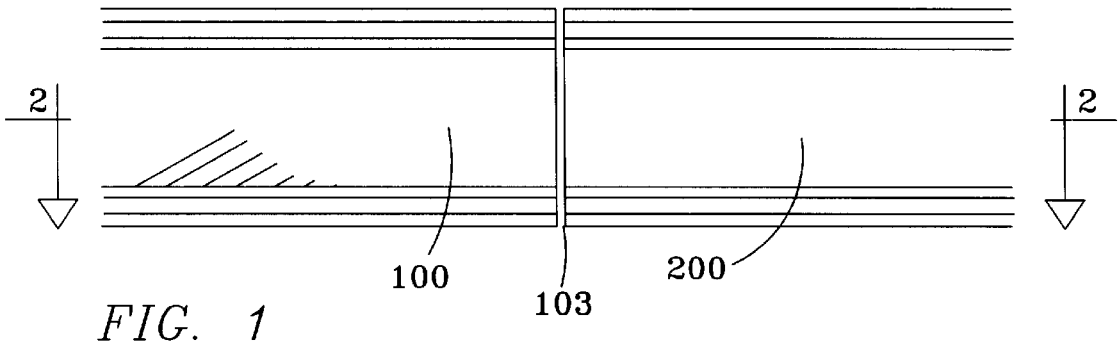
FIG. 1
Prior Art
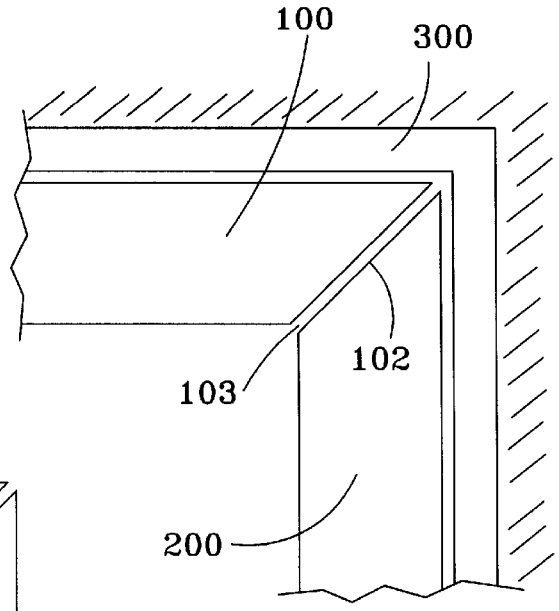
FIG. 2
Prior Art
FIG. 3
Prior Art
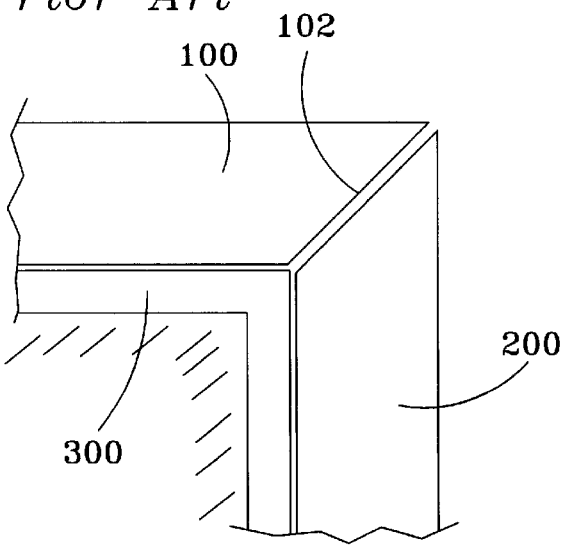

FIG. 4
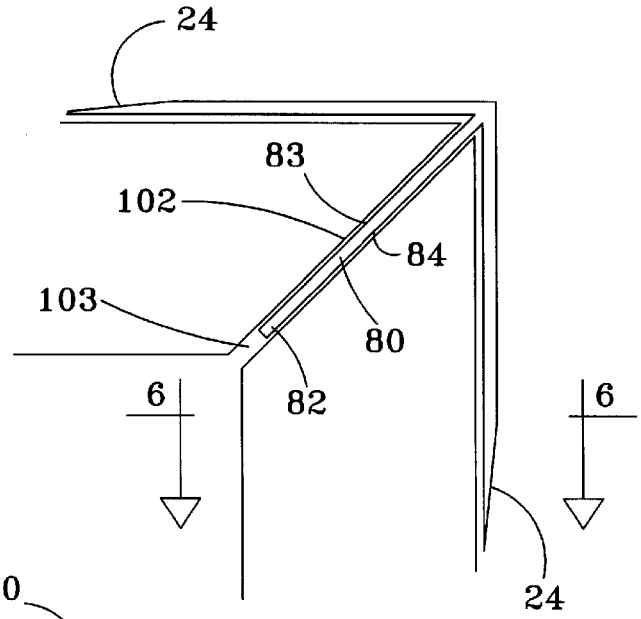
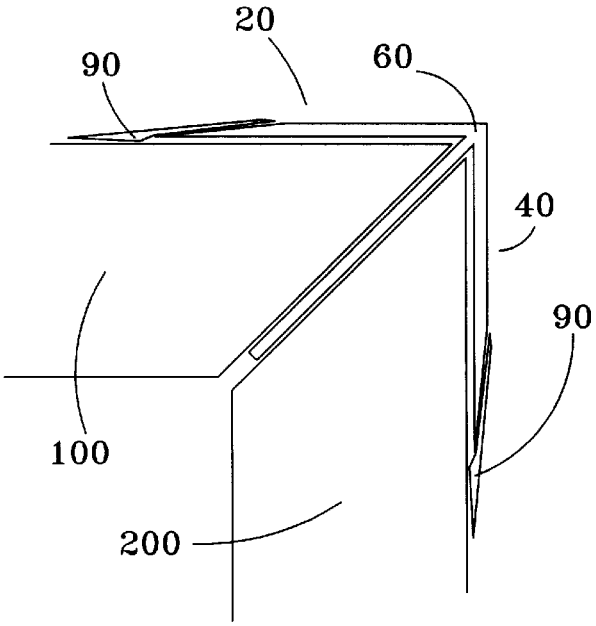
FIG. 5
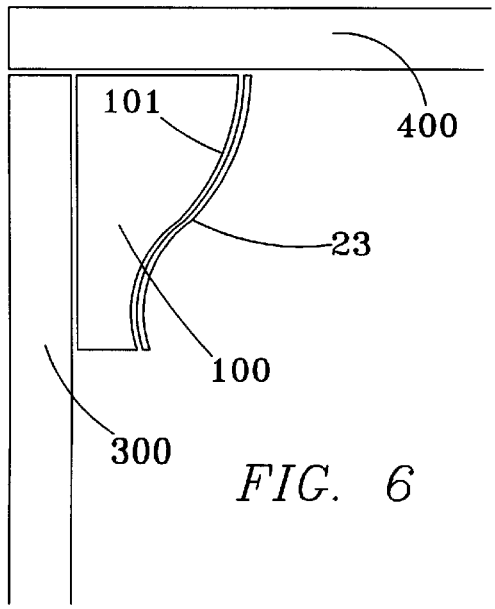
FIG. 6

CORNICE OR CROWN MOLDING FINISHING ACCESSORY

CROSS-REFERENCES

There are no applications related to this application filed in this or any foreign country.

BACKGROUND

During building and home construction, the finishing of cornice or crown moldings is a difficult, expensive and time-consuming process. The finishing process of both inside and outside cornice or crown molding corners experience similar difficulties. In both cases, two segments of molding having ends which typically meet but do not touch at the corner must be provided with a visually aesthetic finish. The area between the molding segments must be finished in a manner that results in the appearance of a smooth and unbroken molding which wraps about the inside or outside corner without a break, gap or discontinuity.

The prior art method of finishing such gaps between cornice or crown molding elements is to fill the gap area with drywall mud and to allow the mud to set-up. Once sufficiently hardened to work with, a skilled tradesman is required to carve, sand and polish the set drywall mud to conform with the appearance of the cornice or crown molding segments on either side of the gap. Due to the nature of the aesthetic pattern on the surface of many such moldings, as well as the nature of the thin and sharp corner required, it is typically the case that even the work of the best craftsman still results in noticeable imperfections.

A less labor-intensive method seen in the prior art is to use decorative molding corner caps. Such caps totally enclose the area of intersection between two cornice or crown molding segments, and thereby hide the gap area between the two segments. Unfortunately, there are several problems with this method as well. First, different decorative molding corner caps would be required for each cornice or crown molding pattern. Second, different molding corner caps would be required for inside and outside corners, and for corners of any angle other than 90 or 270 degrees. Third, unless the corner cap is made of the same material as the cornice or crown molding, the appearance is somewhat degraded. And fourth, due to the size of the corner cap, which must necessarily be larger than the molding segments, some aesthetic degradation results. This is because the smooth and continuous lines of a first molding segment do not directly continue with the second molding segment, but instead are broken by the molding cap.

For the foregoing reasons, there is a need for a cornice or crown molding accessory that is economical to use, that allows rapid formation of the finish between two segments of cornice or crown molding and that results in a level of finish that is aesthetically pleasing and superior to that which is achieved by prior art methods.

SUMMARY

The present invention is directed to an apparatus that satisfies the above needs. A novel cornice or crown molding finishing accessory is disclosed that is economical to use, that allows rapid formation of the finish between two segments of cornice or crown molding by relatively unskilled workers and that results in a level of finish that is aesthetically pleasing and superior to that which is achieved by prior art methods.

The cornice or crown molding accessory 10 of the present invention provides some or all of the following elements.

(A) Mirror-image first and second facade-creating flanges 20, 40 are made of a thin, yet rigid film, and are joined at a vertex 60. The flanges have a surface configuration defining a molding-conforming curve that is keyed to the cornice or crown molding being used. That is, a lengthwise cross-sectional view of the facade-creating flanges has the same appearance as the outer surface of the molding segment.

(B) In one embodiment of the cornice or crown molding accessory, an anchor element 80 extends from the vertex, along a line of symmetry between the first and second flanges, where it may be inserted into the gap formed between the first and second molding segments. A first embodiment of the anchor element is made of substantially flat sheet material.

A second embodiment of the anchor element is formed by sheet material bent into a wave configuration, i.e. a cross-sectional view of the anchor element resembles a sine wave. The first and second molding segments should be installed in a manner that results in less distance between their respective cut ends than is present between the upper and lower portions of the wave. As a result, when the wave shaped anchor element is inserted between the molding segments, the wave is somewhat compressed. Due to the compression, the wave crests are biased against the cut end surfaces of the first and second molding segments, thereby holding the anchor element and therefore the entire cornice or crown molding accessory 10 in place.

The method of using the cornice or crown molding accessory 10 of the present invention includes some or all of the following steps.

(A) First and second cornice or crown molding segments are installed on adjacent walls at the ceiling of a room. The cut end surfaces of the segments are oriented at approximately 45 degrees to the length of each segment, and are separated from each other by a small gap.

(B) Where the molding segments form an inside corner, an inside corner accessory 11 is selected, and where the molding segments form an outside corner an outside corner accessory 12 is selected.

(C) When used, an anchor element 80 is inserted into the gap between the end surfaces of the molding segments. Where the anchor element is of the type having a wave configuration, the wave elements are pressed against the end surfaces of the molding segments, thereby maintaining the position of the entire molding accessory.

(D) A very thin layer of drywall "mud" is brushed over the first and second facade-creating flanges of the molding accessory. Due to the tapered end portions of the flanges, the thin layer of mud results in an attractive, uniform and continuous appearance.

(E) The molding segments and drywall mud covered molding accessory may then be painted or otherwise finished, as desired.

It is therefore a primary advantage of the present invention to provide a novel cornice or crown molding accessory that allows rapid formation of the finish between two segments of cornice or crown molding by relatively unskilled workers.

Another advantage of the present invention is to provide a novel cornice or crown molding accessory is disclosed that is economical to use.

A still further advantage of the present invention is to provide a novel cornice or crown molding accessory is disclosed that results in a level of finish that is aesthetically pleasing and superior to that which is achieved by prior art methods.

Other objectives, advantages and novel features of the invention will become apparent to those skilled in the art upon examination of the specification and the accompanying drawings.

DRAWINGS

These and other features, aspects, and advantages of the present invention will become better understood with regard to the following description, appended claims, and accompanying drawings where:

FIG. 1 is an orthographic view of first and second cornice or crown molding segments installed on a wall, which is not shown. A gap is defined between the end surfaces of the molding segments, which are typically cut at 45 degrees with respect to the length of the molding segments. The cornice or crown molding finishing accessory 10 is not installed in this view, so that the molding segments to which it is attached may be better viewed.

FIG. 2 is a thin section view taken along the 2—2 lines of FIG. 1, additionally showing the inside corner made of drywall or similar material.

FIG. 3 is a view similar to that of FIG. 2, but illustrating the alternative circumstance wherein the molding elements are attached to an outside corner. Such outside corners are commonly found around support pillars and in other areas.

FIG. 4 is an enlarged view similar to that of FIG. 3, illustrating the molding finishing accessory 10 installed in an outside corner application.

FIG. 5 is an enlarged view similar to that of FIG. 4, illustrating the use of drywall "mud" to taper between the molding segments and the molding-finishing accessory.

FIG. 6 is a cross-section view of the ceiling, wall, molding and facade-creating flange of the molding finishing accessory, taken along the 6—6 lines of FIG. 4.

DESCRIPTION

Figure 7:
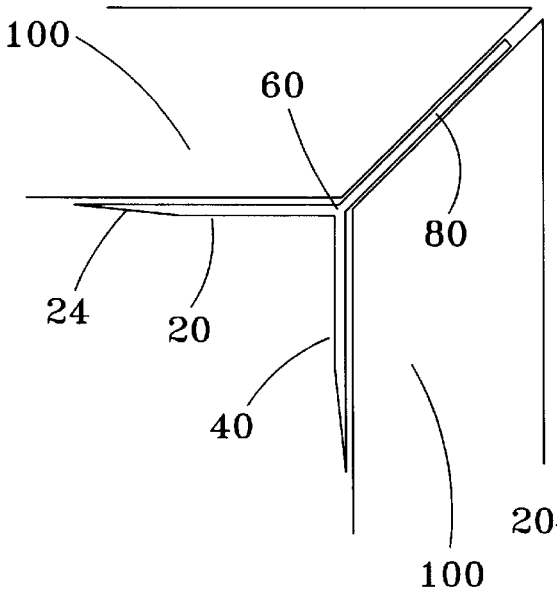
FIG. 7 is a view similar to that of FIG. 4, prior to the application of drywall "mud," in an inside corner application.
Figure 8:
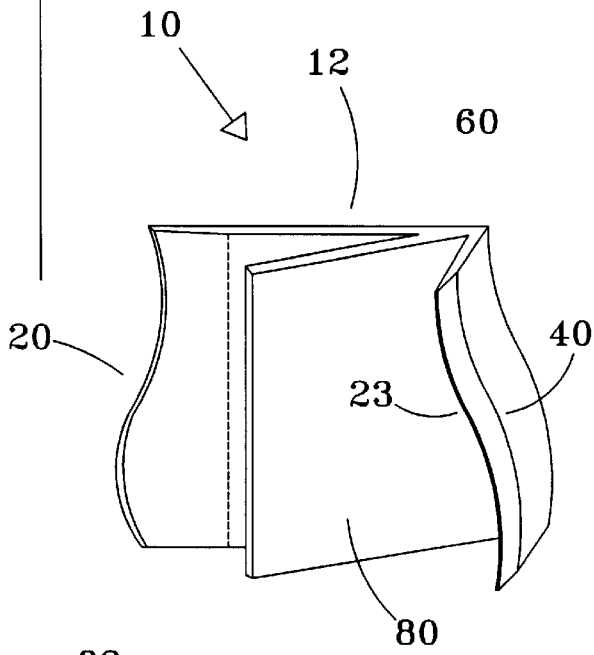
FIG. 8 is an isometric view of a molding-finishing accessory adapted for use with outside corners.
Figure 9:
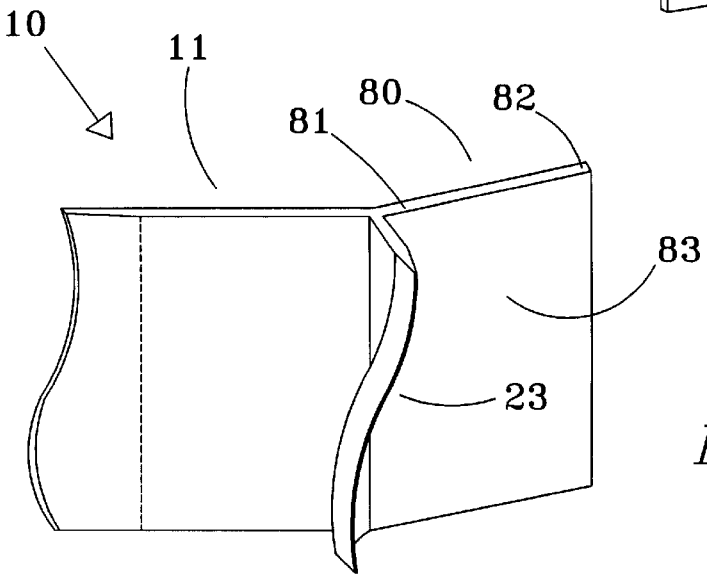
FIG. 9 is a view similar to that of FIG. 7, wherein the molding finishing accessory is adapted for use with inside corners.

Referring in generally to FIGS. 4 through 14, a cornice or crown molding-finishing accessory 10 constructed in accordance with the principles of the invention is seen. The finishing accessory is adapted for use in creating a smooth, continuous and aesthetic finish to the joint between first and second molding segments 100, 200. These molding segments may form inside or outside corners, as seen in FIGS. 2 and 3, respectively. Referring particularly to FIGS. 8 and 9, preferred examples of the finishing accessory adapted for use with outside and inside 90 degree corners, respectively, are seen. The molding finishing accessory provides first and second facade-creating flanges 20, 40 that have a cross-sectional shape including a molding-conforming curve 23 designed to match the cross-sectional decorative surface of the molding segments. The flanges meet at a vertex 60. In one version of the molding accessory, an anchor element extends form the vertex. In use, where an anchor element 80 available, it is inserted into a gap defined between the first and second molding segments, thereby holding the finishing accessory in place. A thin layer of drywall "mud" is brushed over flanges of the finishing accessory and adjacent areas of the molding segments, thereby smoothing over any lines of transition between the finishing accessory and the molding segments. The resulting appearance is that of a perfect transition between the first and second molding segments, and complete masking of the gap between these segments.

As seen in FIG. 8, an outside corner version 12 of the finishing accessory 10 is seen. A preferred outside corner version is adapted to 90 degree outside corners, i.e. 270-degree corners, but could alternatively be adapted for use with corners of a greater or lesser angle, such as 290 or 250 degrees.

Similarly, as seen in FIG. 9, an inside corner version 11 of the finishing accessory is seen. A preferred inside corner version is adapted for use with 90 degree inside corners, but could alternatively be adapted for use with corners of a greater or lesser angle, such as 70 or 110 degrees.

As seen in FIGS. 4–11, mirror image first and second facade-creating flanges 20, 40 are made of a thin, yet rigid film, and are joined at a vertex 60. Each flange has an outer surface 21 and an inner surface 22. The flanges are typically not planar; i.e. the flanges are formed in a molding-conforming curve 23, best seen in the cross-sectional view of FIG. 6, and in FIGS. 8 and 9. As a result of the molding conforming curve, the inner surface 22 of the flange fits snugly against the outside surface of the molding.

It is a significant characteristic of the molding finishing accessory 10 of the invention that the molding-conforming curve 23 is formed specifically to match the decorative surface 101 of the molding to be used. That is, each molding shape will result in an associated molding conforming curve 23 for the flanges of the molding finishing accessory.

For example, as seen in FIG. 6, the outer and inner surfaces 21, 22 of the flange illustrated conform to the curve of the decorative surface 101 that is present in the cornice or crown molding 100 illustrated. As a result of the molding conforming curve, the inner surface 22 of each flange fits exactly to the outer surface of the molding.

Referring to FIGS. 4, 5, 7, 10 and 11, it can be seen that the flanges 20, 40 both have tapered end portions 24. The tapered end portions result in a gradual transition from the full thickness of the flanges 20, 40 to the cornice or crown segment uncovered by the molding finishing accessory 10. As a result, an observer does not visually detect a transition line at which the molding segment is covered by the molding finishing accessory 10.

Referring to FIG. 5, it can be seen that a small amount of drywall "mud" 90 may be brushed over the molding finishing accessory, particularly covering the tapered end portions 24 of the flanges 20, 40. The mud tends to mask even the subtle transition lines at the edges of the tapered portions.

After the mud is applied, the entire cornice or crown molding and the molding finishing accessory 10 may be finished with paint or other material, as desired.

Figure 10:
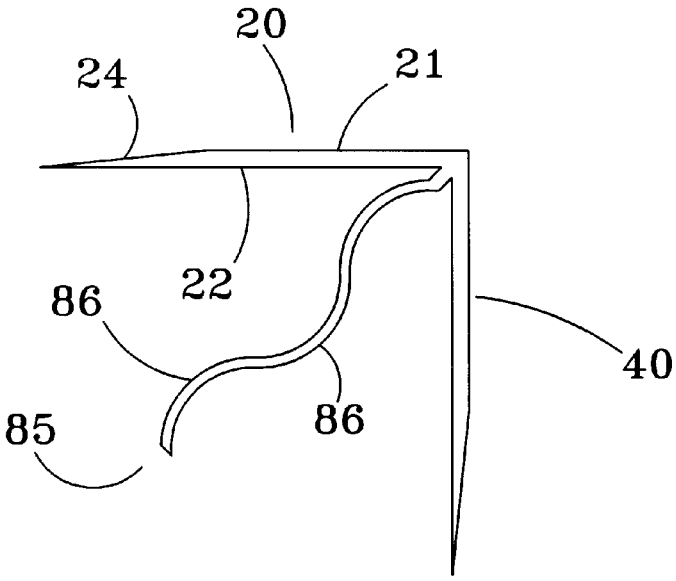
FIG. 10 is a plan isometric view of a version of the molding-finishing accessory, adapted for use on an outside corner, having an anchor element in a wave configuration.
Figure 11:
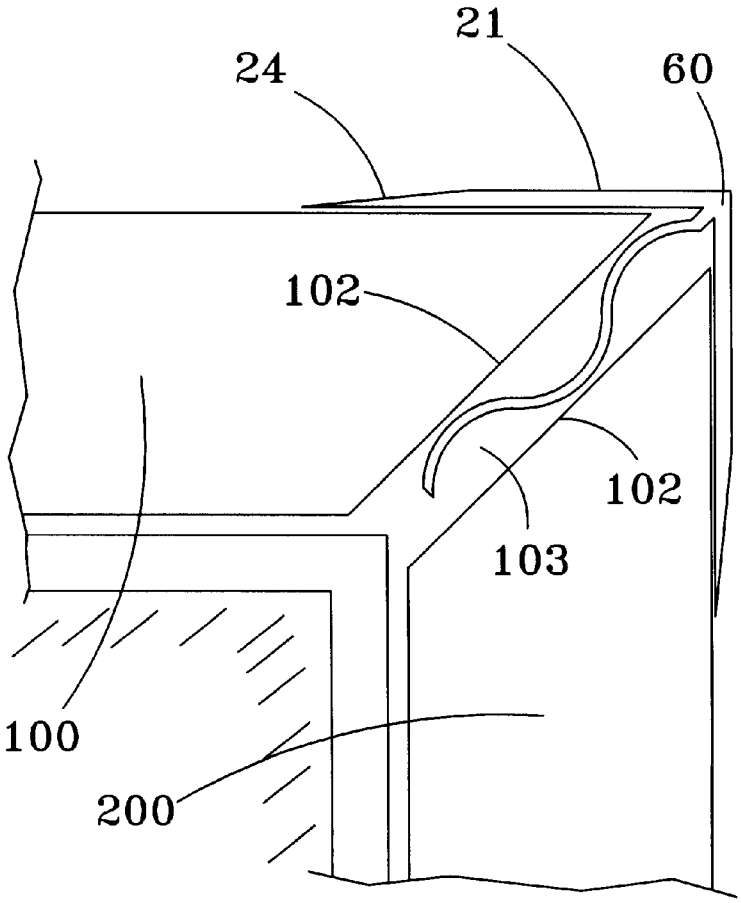
FIG. 11 is a view similar to that of FIG. 5, with the finishing accessory of FIG. 10 installed
Figure 14:
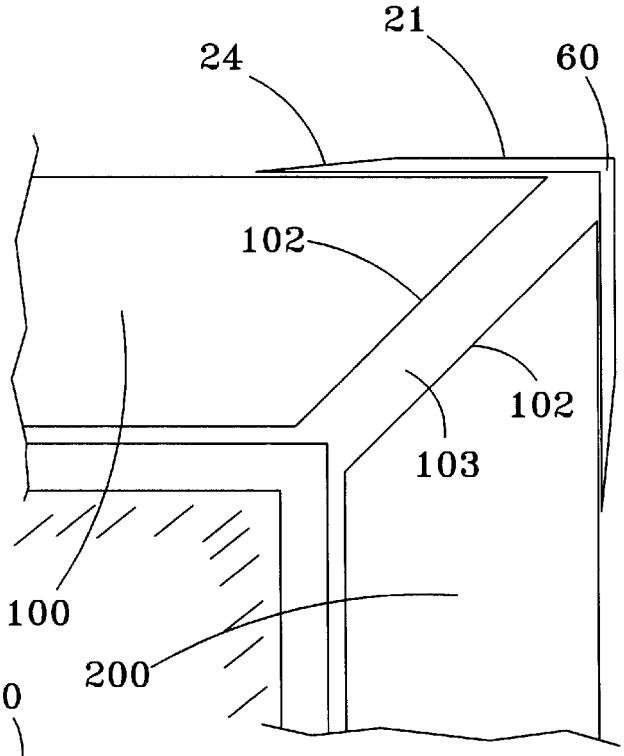
FIG. 14 is a plan isometric plan view of the molding accessory of FIG. 12 installed on an outside corner.
Figure 12:
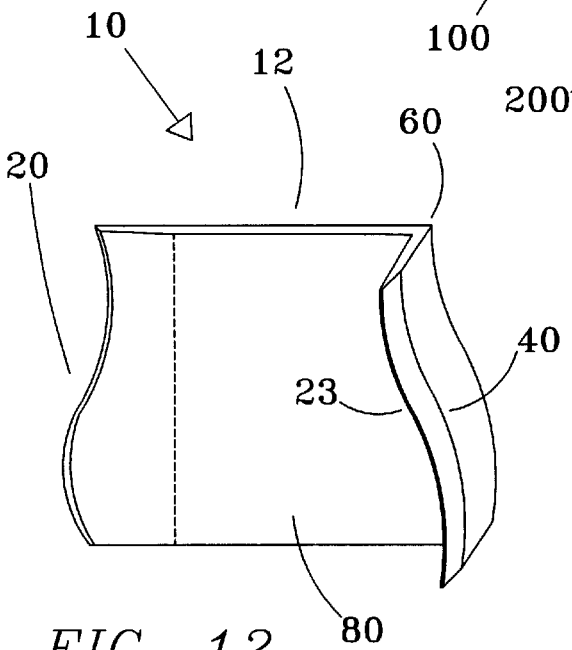
FIG. 12 is an isometric view similar to that of FIG. 8, illustrating a version of the molding accessory having no anchor element 80, and particularly illustrating a version of the molding accessory adapted for use with an outside corner.
Figure 13:
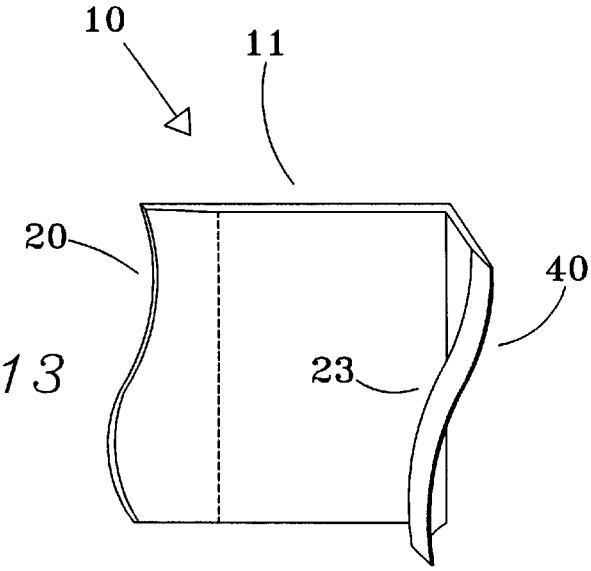
FIG. 13 is an isometric view similar to that of FIG. 9, illustrating a version of the molding accessory having no anchor element that is adapted for use in an inside corner.

As seen in FIGS. 4 through 9, in a first version of the finishing accessory 10 has a planar version of the anchor element 80 present. Alternatively, as seen in FIGS. 10 and 11, a second version of the anchor element is a non-planar wave. In a still further version of the finishing accessory, seen in FIGS. 12 through 14, no anchor element is present. Where no anchor element is present, the drywall mud 90 retains the finishing accessory 10 in position against the molding segments 100, 200.

As seen in FIGS. 4 through 11, where in both the inside corner and outside corner versions of the finishing accessory where an anchor element is present, the anchor element passes along a line of symmetry between the first and second flanges. As seen in FIG. 8, the anchor element 80 extends between the flanges where an outside corner is to be made. Similarly, as seen in FIG. 9, the anchor element extends opposite the flanges where an inside corner is to be made.

The first version of the anchor element 80, seen in FIGS. 4 through 9 is planar sheet material. An inner end 81 of the anchor element is attached to the vertex 60, while an insertion end 82 is inserted into the gap 103 between adjacent molding segments. Once inserted, first and second side surfaces 83, 84 are adjacent to the cut end surfaces 102 of the molding segments 100, 200.

A second embodiment of the anchor element is made of sheet material having a wave configuration 85, i.e. a cross-sectional view of the anchor element resembles a sine wave. The first and second molding segments 100, 200 should be installed in a manner that results in less distance between their respective cut ends than is present between the upper and lower portions of the wave. As a result, when the wave inserted between the molding segments, the wave is somewhat compressed. Due to the compression, the wave crests 86 are biased against the cut end surfaces of the first and second molding segments, thereby holding the anchor element and cornice or crown molding accessory 10 in place.

The method of using the cornice or crown molding accessory 10 of the present invention includes some or all of the following steps.

First and second cornice or crown molding segments 100, 200 are installed on adjacent walls 300 at the ceiling 400 of a room forming either an inside or outside corner. The cut end surfaces of the segments are oriented at approximately 45 degrees to the length of each segment and are separated from each other by a small gap.

It must be determined if the molding segments form an inside or outside corner. Where the molding segments form an inside corner, an inside corner accessory 11 is selected, and where the molding segments form an outside corner an outside corner accessory 12 is selected. An example of an inside corner is illustrated in FIG. 2, while an example of an outside corner is illustrated in FIG. 3.

Where the molding accessory has an anchor element 80, the insertion end 82 of the anchor element is inserted into the gap 103 between the cut end surfaces 102 of the first and second molding segments. If helpful, a small amount of drywall mud may be inserted, to aid in maintaining the position of the anchor. The anchor is inserted fully, until the flanges 20, 40 are flush with the surfaces of the molding segments.

Where an anchor element of the type having a wave configuration is used, the wave crests 86 are pressed against the cut end surfaces 102 of the molding segments, thereby maintaining the position of the entire molding accessory.

A very thin layer of drywall "mud" is brushed over the outer surface 21 and tapered end portions 24 of the first and second facade creating flanges of the molding accessory. Due to the combination of the tapered end portions of the flanges and the thin layer of mud, an attractive, uniform and continuous appearance results.

The molding segments and drywall mud covered molding accessory 10 may then be finished, typically with paint or other coating, as desired.

The previously described versions of the present invention have many advantages, including a primary advantage of providing a novel cornice or crown molding accessory that allows rapid formation of the finish between two segments of cornice or crown molding by relatively unskilled workers.

Another advantage of the present invention is to provide a novel cornice or crown molding accessory is disclosed that is economical to use.

A still further advantage of the present invention is to provide a novel cornice or crown molding accessory is disclosed that results in a level of finish that is aesthetically pleasing and superior to that which is achieved by prior art methods.

Although the present invention has been described in considerable detail and with reference to certain preferred versions, other versions are possible. For example, while cornice or crown molding accessories of certain preferred angles have been disclosed, including particularly inside and outside 90 degree angles, it is clear that the teachings of the invention could be adapted to molding accessories of a variety of different angles. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A crown molding accessory for attachment to first and second molding segments, the crown molding accessory comprising:

(A) mirror-image first and second facade-creating flanges joined at a vertex, the facade-creating flanges having a molding-conforming curve; and (B) an anchor element, extending from the vertex along a line of symmetry between the first and second flanges, having a non-planar wave shape with at least two wave crests, wherein the anchor element when slightly compressed is insertable between the first and second molding segments in a manner that frictionally biases the wave crests against the first and second molding segments, and wherein the at least two wave crests are adapted to make contact with an end portion of each of the first and second molding segments.

2. A crown molding accessory, for attachment to first and second molding segments, comprising:

(A) mirror-image first and second facade-creating flanges joined at a vertex, the facade-creating flanges having a molding-conforming curve; and (B) an anchor element, configured as a wave having a plurality of crests, extending from the vertex along a line of symmetry between the first and second flanges, wherein the anchor element, when slightly compressed, is insertable between the first and second molding segments in a manner that biases the wave crests against the first and second molding segments.

3. A method of installing two adjacent crown molding segments and finishing the gap defined between them, comprising:

(A) installing first and second crown molding segments on adjacent walls and a ceiling of a room, thereby forming a corner;

(B) determining if the molding segments form an inside corner or an outside corner;

(C) where an inside corner is formed, selecting an inside corner accessory and where an outside corner is formed, selecting an outside corner accessory;

(D) inserting an insertion end of an anchor element of the accessory into a gap defined between adjacent cut end surfaces of the first and second molding segments until first and second facade-creating flanges of the accessory are flush with surfaces of the molding segments;

(E) applying a very thin layer of drywall "mud" over tapered end portions of the first and second facade-creating flanges of the accessory; and (F) finishing the molding segments and drywall mud covered accessory.

* * * * *